US005611216A

United States Patent [19]

Low et al.

[11] Patent Number: 5,611,216

[45] Date of Patent: Mar. 18, 1997

[54] METHOD OF LOAD DISTRIBUTION IN A CASCADED REFRIGERATION PROCESS

[76] Inventors: William R. Low, 1000 Grandview Rd.; Donald L. Andress, 306 Stoneridge; Clarence G. Houser, 1803 SE. Harned Dr., all of Bartlesville, Okla. 74006

[21] Appl. No.: 575,436

[22] Filed: Dec. 20, 1995

[51] Int. Cl.[6] ..... F25J 1/00

[52] U.S. Cl. ..... 62/612; 62/935

[58] Field of Search ..... 62/612, 935

[56] References Cited

U.S. PATENT DOCUMENTS

| | | | |
|---|---|---|---|
| 3,342,037 | 9/1967 | Kniel | 62/612 |
| 3,808,826 | 5/1974 | Harper | 62/612 |
| 4,172,711 | 10/1979 | Bailey | 62/21 |
| 4,690,080 | 10/1987 | Gray et al. | 621/21 |
| 5,036,671 | 8/1991 | Nelson | 62/612 |

OTHER PUBLICATIONS

Kniel, L. (1973). *Chemical Engineering Progress* (vol. 69, No. 10) entitled "Energy Systems for LNG Plants".

Harper, E. A., Rust, J. R. and Lean, L. E. (1975). *Chemical Engineering Progress* (vol. 71, No. 11) entitled "Trouble Free LNG".

Haggin, J. (1992). *Chemical and Engineering News* (Aug. 17, 1992) entitled "Large Scale Technology Characterizes Global LNG Activities" provides background information concerning the relative scale of projects for natural gas liquefaction.

Collins, C., Durr, C. A., de la Vega, F. F. and Hill, D. K. (1995). *Hydrocarbon Processing* (Apr. 1995) entitled "Liquefaction Plant Design in the 1990s" generally discloses basic background information concerning recent developments in the production of LNG.

*Primary Examiner*—Ronald C. Capossela
*Attorney, Agent, or Firm*—Gary L. Haag

[57] ABSTRACT

A process, apparatus and control methodology for transferring loads between drivers in adjacent refrigeration cycles in a cascaded refrigeration process has been developed thereby enabling more efficient driver operation. Load transfer is effected by cooling the higher boiling point refrigerant liquid prior to flashing via an indirect heat transfer with the lower boiling point refrigerant vapor in a adjacent cycle prior to compression of said stream.

22 Claims, 2 Drawing Sheets

METHOD OF LOAD DISTRIBUTION IN A CASCADED REFRIGERATION PROCESS

This invention concerns a method and an apparatus for distributing the total compressor load among multiple gas turbine compressor drivers in a cascaded refrigeration process thereby enabling more efficient driver operation.

BACKGROUND

Cryogenic liquefaction of normally gaseous materials is utilized for the purposes of component separation, purification, storage and for the transportation of said components in a more economic and convenient form. Most such liquefaction systems have many operations in common, regardless of the gases involved, and consequently, have many of the same problems. One common operation and its attendant problems is associated with the compression of refrigerating agents and the distribution of compression power requirements among multiple gas turbine drivers when multiple cycles, each with a unique refrigerant, are employed. Accordingly, the present invention will be described with specific reference to the processing of natural gas but is applicable to other gas systems.

It is common practice in the art of processing natural gas to subject the gas to cryogenic treatment to separate hydrocarbons having a molecular weight higher than methane ($C_2$+) from the natural gas thereby producing a pipeline gas predominating in methane and a $C_2$+ stream useful for other purposes. Frequently, the $C_2$+ stream will be separated into individual component streams, for example, $C_2$, $C_3$, $C_4$ and $C_5$+.

It is also common practice to cryogenically treat natural gas to liquefy the same for transport and storage. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks where demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significant reduce the specific volume of the gas which in turn requires the use of more expensive storage containers.

In order to store and transport natural gas in the liquid state, the natural gas is preferably cooled to −240° F. to −260° F. where it possesses a near-atmospheric vapor pressure. Numerous systems exist in the prior art for the liquefaction of natural gas or the like in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, and methane. In the art, the refrigerants are frequently arranged in a cascaded manner and each refrigerant is employed in a closed refrigeration cycle. Further cooling of the liquid is possible by expanding the liquefied natural gas to atmospheric pressure in one or more expansion stages. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, significant volumes of liquefied gas are flashed. The flashed vapors from the expansion stages are generally collected and recycled for liquefaction or utilized as fuel gas for power generation.

Obviously, the compressor or compressors employed for compressing the refrigerating agent for a given cycle have operating regimes which are preferred based on turbine/compressor efficiencies and equipment reliability/life expectancy. As an example, the overloading of a given compressor will result in undue wear or damage to that compressor. Unfortunately, a number of operating conditions exist which can fluctuate and affect the loading of individual compressors. Such fluctuations include but are not limited to changes in inlet gas composition, changes in the turbine and compressor efficiency associated with a given refrigerant, changes in climate which affect available turbine horsepower, changes in the return rate of boil-off vapor resulting from ship loading/nonloading conditions, changes attributed to turbine shut-down or start-up (either scheduled or unscheduled) when more than one turbine is used in parallel operation, and changes in the temperature, pressure, flowrate, or composition of the stream to be liquefied resulting from various process operations (fractionating unit, heat exchanger etc.) While individual turbines which drive compressors processing various refrigerants can be protected by such means as speed control mechanisms or the like, such protective means are not a complete answer because changes in the operation of one turbine will change the operation of the entire cryogenic system and can result in the overloading or unbalanced loading of other compressors.

SUMMARY OF THE INVENTION

It is an object of this invention to increase process efficiency in a liquefaction process by distributing compressor loading among the gas turbine compressor drivers in a cascaded refrigeration process thereby enabling more efficient driver operation.

It is a further object of this invention to increase total refrigeration capacity in a cascaded process by employing refrigeration capacity available via one or more underutilized gas turbine refrigerant drivers.

It is a still further object of the present invention to maintain loading of each compressor at optimal or near-optimal loadings by distributing loading among the available refrigerant compressors.

It is still yet a further object of this invention that the loading distribution method and associated apparatus be simple, compact and cost-effective.

It is yet a further object of this invention that the loading distribution method and apparatus employ readily available components.

In one embodiment of this invention, an improved process for transferring compressor loads between gas turbine drivers associated with different refrigeration cycles in a cascaded refrigeration process has been discovered wherein said process nominally comprises contacting a higher boiling point refrigerant liquid via an indirect heat transfer means with a lower boiling point refrigerant vapor prior to flashing said higher boiling point refrigerant liquid and prior to returning vapor of said lower boiling point refrigerant to the compressor for the lower boiling point refrigerant.

In another embodiment of this invention, an apparatus for transferring compressor loading among gas turbine drivers associated with different refrigeration cycles in a cascaded refrigeration cycle has been discovered comprising a compressor, an indirect heat transfer means, a conduit for flowing a higher boiling point refrigerant liquid to said indirect heat transfer means, a conduit for flowing a lower boiling point refrigerant vapor to said indirect heat transfer means, the indirect heat transfer means, a conduit for flowing the lower boiling point refrigerant vapor from the indirect heat transfer means to a compressor, an indirect heat transfer means, a conduit for flowing the higher boiling point refrigerant liquid to a pressure reduction means and the pressure reduction means.

In still yet another embodiment of this invention, an improved control methodology for balancing loads between gas turbine drivers in adjacent refrigeration cycles in a cascaded refrigeration process has been discovered wherein a higher boiling point refrigerant liquid in one cycle is cooled prior to flashing by contact via an indirect heat transfer means with a lower boiling point refrigerant vapor in a adjacent cycle prior to compression of said vapor, the process comprising (1) determining the loadings of the gas turbine drivers for the higher boiling point and lower boiling point refrigeration cycles, (2) comparing the respective loadings of each driver thereby determining the direction of driver loading transfer for more efficient driver operation, (3) flowing at least a portion of the lower boiling point refrigerant vapor stream to an indirect heat transfer means thereby producing a heated vapor stream, (4) flowing said heated vapor stream to the low boiling point refrigerant compressor, (5) splitting the high boiling point refrigerant liquid stream into a first liquid stream and a second liquid stream, (6) flowing said second liquid stream to said indirect heat transfer means thereby producing a cooled second stream, (7) controlling the relative flow of said first stream and said second stream responsive to step (2) above via a control valve wherein the flowrate of said second liquid stream is increased as load transfer to the lower boiling point refrigerant driver is increased, and (8) recombining said processed second stream with said first stream to produce a combined stream and flowing said combined stream to a pressure reduction means or flowing said first stream and said processed second stream to separate pressure reduction means.

DESCRIPTION OF THE PREFERRED EMBODIMENTS

Figure 1:
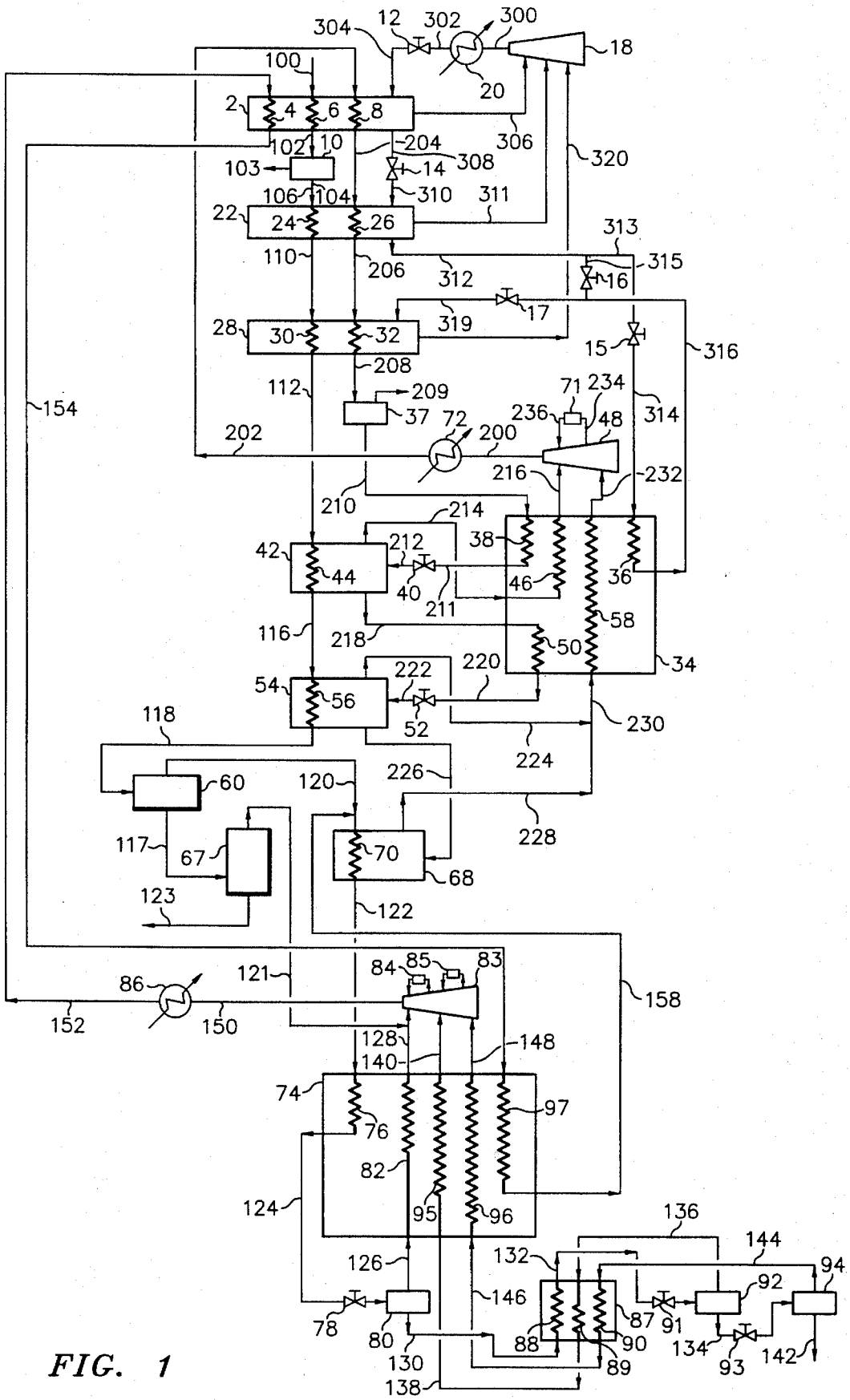
FIG. 1 is a simplified flow diagram of a cryogenic LNG production process which illustrates the load distribution methodology and apparatus of the present invention.

While the present invention is applicable to load distribution among a plurality of gas turbine drivers which in turn drive compressors for compressing refrigerating agents which are then employed in the cryogenic processing of gas, the following description for the purposes of simplicity and clarity will be confined to the cryogenic cooling of a natural gas stream to produce liquefied natural gas. The problems associated with load distribution are common to all cryogenic gas cooling processes which employ multiple compression cycles and multiple gas turbine drivers.

As noted in the background section hereof, so long as the feed rate to a cryogenic gas cooling process is maintained below a predetermined maximum, which maximum has been selected on the basis of efficient operation of the process and limitations of the equipment including the capacity of the compressors and neither the character of the gas nor the process operating conditions change, the process will operate efficiently within the limits of the equipment, particularly the turbine-compressor units. However, such normal and constant operations cannot be maintained at all times. For example, there are a number of compressor-limiting operating conditions which fluctuate during the operation. Such fluctuations can be of a daily or seasonal variety or can be attributed to wear and tear and decreased operating efficiency of various process-train components. These fluctuations include but are not limited to changes in inlet gas composition, changes in ambient conditions that affect turbine horsepower, changes in turbine/compressor efficiencies for a given refrigeration cycle, changes associated with variable LNG boil-off attributed to such factors as ship loading and unloading, changes resulting from the shut-down and start-up of a turbine (either scheduled or unscheduled) if more than one turbine is utilized in parallel operation for a given refrigerant cycle, and changes associated with the operation of various process operations which may affect in-situ stream compositions and flowrates such as fractionation units, flash vessels, separators and so forth. The effects of such changes or fluctuations on the operation of turbine-compressor units and the resulting process throughput are greatly reduced in accordance with the present invention.

Natural Gas Stream Liquefaction

Cryogenic plants have a variety of forms; the most efficient and effective being a cascade-type operation and this type in combination with expansion-type cooling. Also, since methods for the production of liquefied natural gas (LNG) include the separation of hydrocarbons of higher molecular weight than methane as a first part thereof, a description of a plant for the cryogenic production of LNG effectively describes a similar plant for removing $C_2$+hydrocarbons from a natural gas stream.

In the preferred embodiment which employs a cascaded refrigerant system, the invention concerns the sequential cooling of a natural gas stream at an elevated pressure, for example about 650 psia, by sequentially cooling the gas stream by passage through a multistage propane cycle, a multistage ethane or ethylene cycle and either (a) a closed methane cycle followed by a single- or a multistage expansion cycle to further cool the same and reduce the pressure to near-atmospheric or (b) an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point.

Pretreatment steps provide a means for removing undesirable components such as acid gases, mercaptans, mercury and moisture from the natural gas stream feed stream delivered to the facility. The composition of this gas stream may vary significantly. As used herein, a natural gas stream is any stream principally comprised of methane which originates in major portion from a natural gas feed stream, such feed stream for example containing at least 85% by volume, with the balance being ethane, higher hydrocarbons, nitrogen, carbon dioxide and a minor amounts of other contaminants such as mercury, hydrogen sulfide, mercaptans. The pretreatment steps may be separate steps located either upstream of the cooling cycles or located downstream of one of the early stages of cooling in the initial cycle. The following is a non-inclusive listing of some of the available means which are readily available to one skilled in the art. Acid gases and to a lesser extent mercaptans are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves. Processes employing sorbent beds are generally located downstream of the first cooling stage in the initial cooling cycle.

The natural gas is generally delivered to the liquefaction process at an elevated pressure or is compressed to an elevated pressure, that being a pressure greater than 500 psia, preferably about 500 to about 900 psia, still more preferably about 600 to about 675 psia, and most preferably about 650 psia. The stream temperature is typically near ambient to slightly above ambient. A representative temperature range being 60° F. to 120° F.

As previously noted, the natural gas stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The feed gas is preferably passed through an effective number of refrigeration stages, nominally 2, preferably two to four, and more preferably three stages, in the first closed refrigeration cycle utilizing a relatively high boiling refrigerant. Such refrigerant is preferably comprised in major portion of propane, propylene or mixtures thereof, more preferably propane, and most preferably the refrigerant consists essentially of propane. Thereafter, the processed feed gas flows through an effective number of stages, nominally two, preferably two to four, and more preferably three, in a second closed refrigeration cycle in heat exchange with a refrigerant having a lower boiling point. Such refrigerant is preferably comprised in major portion of ethane, ethylene or mixtures thereof, more preferably ethylene, and most preferably the refrigerant consists essentially of ethylene. Each cooling stage comprises a separate cooling zone.

Generally, the natural gas feed will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a first gas stream predominating in methane and a second liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separators will be dependant on a number of operating parameters, such as the $C_2$+ composition of the natural gas feed stream, the desired BTU content of the LNG product, the value of the $C_2$+ components for other applications and other factors routinely considered by those skilled in the art of LNG plant and gas plant operation. The $C_2$+ hydrocarbon stream or streams may be demethanized via a single stage flash or a fractionation column. In the latter case, the methane-rich stream can be directly returned at pressure to the liquefaction process. In the former case, the methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+). In the last stage of the second cooling cycle, the gas stream which is predominantly methane is condensed (i.e., liquefied) in major portion, preferably in its entirety. The process pressure at this location is only slightly lower than the pressure of the feed gas to the first stage of the first cycle.

The liquefied natural gas stream is then further cooled in a third step or cycle by one of two embodiments. In one embodiment, the liquefied natural gas stream is further cooled by indirect heat exchange with a third closed refrigeration cycle wherein the condensed gas stream is subcooled via passage through an effective number of stages, nominally 2; preferably two to 4; and most preferably 3 wherein cooling is provided via a third refrigerant having a boiling point lower than the refrigerant employed in the second cycle. This refrigerant is preferably comprised in major portion of methane and more preferably is predominantly methane. In the second and preferred embodiment, the liquefied natural gas stream is subcooled via contact with flash gases in a main methane economizer in a manner to be described later.

In the fourth cycle or step, the liquefied gas is further cooled by expansion and separation of the flash gas from the cooled liquid. In a manner to be described, nitrogen removal from the system and the condensed product is accomplished either as part of this step or in a separate succeeding step. A key factor distinguishing the closed cycle from the open cycle is the initial temperature of the liquefied stream prior to flashing to near-atmospheric pressure, the relative amounts of flashed vapor generated upon said flashing, and the disposition of the flashed vapors. Whereas the majority of the flash vapor is recycled to the methane compressors in the open-cycle system, the flashed vapor in a closed-cycle system is generally utilized as a fuel.

In the fourth cycle or step in either the open- or closed-cycle methane systems, the liquefied product is cooled via at least one, preferably two to four, and more preferably three expansions where each expansion employs either Joule-Thomson expansion valves or hydraulic expanders followed by a separation of the gas-liquid product with a separator.

When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment employed in the open-cycle system, additional cooling of the high pressure liquefied product prior to flashing is made possible by first flashing a portion of this stream via one or more hydraulic expanders and then via indirect heat exchange means employing said flashed stream to cool the high pressure liquefied stream prior to flashing. The flashed product is then recycled via return to an appropriate location, based on temperature and pressure considerations, in the open methane cycle.

When the liquid product entering the fourth cycle is at the preferred pressure of about 600 psia, representative flash pressures for a three stage flash process are about 190, 61 and 24.7 psia. In the open-cycle system, vapor flashed or fractionated in the nitrogen separation step to be described and that flashed in the expansion flash steps are utilized in the third step or cycle which was previously mentioned. In the closed-cycle system, the vapor from the flash stages may also be employed as a cooling agent prior to either recycle or use as fuel. In either the open- or closed-cycle system, flashing of the liquefied stream to near atmospheric pressure will produce an LNG product possessing a temperature of −240° to −260° F.

To maintain an acceptable BTU content in the liquefied product when appreciable nitrogen exists in the natural gas feed gas, nitrogen must be concentrated and removed at some location in the process. Various techniques are available for this purpose to those skilled in the art. The following are examples. When an open methane cycle is employed and nitrogen concentration in the feed is low, typically less than about 1.0 vol %, nitrogen removal is generally achieved by removing a small stream at the high pressure inlet or outlet port at the methane compressor. For a closed cycle at similar nitrogen concentrations in the feed gas, the liquefied stream is generally flashed from process conditions to near-atmospheric pressure in a single step, usually via a flash drum. The nitrogen-containing flash vapors are then generally employed as fuel gas for the gas turbines which drive the compressors. The LNG product which is now at near-atmospheric pressure is routed to storage. When the nitrogen concentration in the inlet feed gas is about 1.0 to about 1.5 vol % and an open- or closed-cycle is employed, nitrogen can be removed by subjecting the liquefied gas stream from the third cooling cycle to a flash prior to the fourth cooling step. The flashed vapor will contain an appreciable concentration of nitrogen and may be subsequently employed as a fuel gas. A typical flash pressure for nitrogen removal at these concentrations is about 400 psia. When the feed stream contains a nitrogen concentration of greater than about 1.5 vol % and an open or closed cycle is employed, the flash step following the third cooling step may not provide sufficient nitrogen removal and a nitrogen rejection column will be required from which is produced a nitrogen rich vapor stream and a liquid stream. In a preferred embodiment employing a nitrogen rejection column, the high pressure liquefied methane stream to the methane economizer is split into a first and second portion. The first portion is flashed to approximately 400 psia and the two-phase mixture is fed as a feed stream to the nitrogen rejection column. The second portion of the high pressure liquefied methane stream is further cooled by flowing through the methane economizer, it is then flashed to 400 psia, and the resulting two-phase mixture is fed to the column where it provides reflux. The nitrogen-rich gas stream produced from the top of the nitrogen rejection column will generally be used as fuel. Produced from the bottom of the column is a liquid stream which is fed to the first stage of methane expansion.

Refrigerative Cooling for Natural Gas Liquefaction

Critical to the liquefaction of natural gas in a cascaded process is the use of one or more refrigerants for transferring heat energy from the natural gas stream to the refrigerant and ultimately transferring said heat energy to the environment. In essence, the refrigeration system functions as a heat pump by removing heat energy from the natural gas stream as the stream is progressively cooled to lower and lower temperatures.

The inventive process uses several types of cooling which include but are not limited to (a) indirect heat exchange, (b) vaporization and (c) expansion or pressure reduction. Indirect heat exchange, as used herein, refers to a process wherein the refrigerant cools the substance to be cooled without actual physical contact between the refrigerating agent and the substance to be cooled. Specific examples include heat exchange undergone in a tube-and-shell heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, in the inventive process, a shell-and-tube heat exchange will typically be utilized where the refrigerating agent is in a liquid state and the substance to be cooled is in a liquid or gaseous state, whereas, a plate-fin heat exchanger will typically be utilized where the refrigerant is in a gaseous state and the substance to be cooled is in a liquid state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas-, liquid- or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

In the discussion and drawings to follow, the discussions or drawings may depict the expansion of a refrigerant by flowing through a throttle valve followed by a subsequent separation of gas and liquid portions in the refrigerant chillers wherein indirect heat-exchange also occurs. While this simplified scheme is workable and sometimes preferred because of cost and simplicity, it may be more effective to carry out expansion and separation and then partial evaporation as separate steps, for example a combination of throttle valves and flash drums prior to indirect heat exchange in the chillers. In another workable embodiment, the throttle or expansion valve may not be a separate item but an integral part of the refrigerant chiller (i.e., the flash occurs upon entry of the liquefied refrigerant into the chiller).

In the first cooling cycle, cooling is provided by the compression of a higher boiling point gaseous refrigerant, preferably propane, to a pressure where it can be liquefied by indirect heat transfer with a heat transfer medium which ultimately employs the environment as a heat sink, that heat sink generally being the atmosphere, a fresh water source, a salt water source, the earth or a two or more of the preceding. The condensed refrigerant then undergoes one or more steps of expansion cooling via suitable expansion means thereby producing two-phase mixtures possessing significantly lower temperatures. In one embodiment, the main stream is split into at least two separate streams, preferably two to four streams, and most preferably three streams where each stream is separately expanded to a designated pressure. Each stream then provides vaporative cooling via indirect heat transfer with one or more selected streams, one such stream being the natural gas stream to be liquefied. The number of separate refrigerant streams will correspond to the number of refrigerant compressor stages. The vaporized refrigerant from each respective stream is then returned to the appropriate stage at the refrigerant compressor (e.g., two separate streams will correspond to a two-stage compressor). In a more preferred embodiment, all liquefied refrigerant is expanded to a predesignated pressure and this stream then employed to provide vaporative cooling via indirect heat transfer with one or more selected streams, one such stream being the natural gas stream to be liquefied. A portion of the liquefied refrigerant is then removed from the indirect heat transfer means, expansion cooled by expanding to a lower pressure and correspondingly lower temperature where it provides vaporative cooling via indirect heat transfer means with one or more designated streams, one such stream being the natural gas stream to be liquefied. Nominally, this embodiment will employ two such expansion cooling/vaporative cooling steps, preferably two to four, and most preferably three. Like the first embodiment, the refrigerant vapor from each step is returned to the appropriate inlet port at the staged compressor.

In the preferred cascaded embodiment, the majority of the cooling for refrigerate liquefaction of the lower boiling point refrigerants (i.e., the refrigerants employed in the second and third cycles) is made possible by cooling these streams via indirect heat exchange with selected higher boiling refrigerant streams. This manner of cooling is referred to as "cascaded cooling." In effect, the higher boiling refrigerants function as heat sinks for the lower boiling refrigerants or stated differently, heat energy is pumped from the natural gas stream to be liquefied to a lower boiling refrigerant and is then pumped (i.e., transferred) to one or more higher boiling refrigerants prior to transfer to the environment via an environmental heat sink (ex., fresh water, salt water, atmosphere). As in the first cycle, refrigerant employed in the second and third cycles are compressed via multi-staged compressors to preselected pressures. When possible and economically feasible, the compressed refrigerant vapor is first cooled via indirect heat exchange with one or more cooling agents (ex., air, salt water, fresh water) directly coupled to environmental heat sinks. This cooling may be via inter-stage cooling between compression stages or cooling of the compressed product. The compressed stream is then further cooled via indirect heat exchange with one or more of the previously discussed cooling stages for the higher boiling point refrigerants.

The second cycle refrigerant, preferably ethylene, is preferably first cooled via indirect heat exchange with one or more cooling agents directly coupled to an environmental heat sink (i.e., inter-stage and/or post-cooling following compression) and then further cooled and finally liquefied via sequentially contacted with the first and second or first, second and third cooling stages for the highest boiling point refrigerant which is employed in the first cycle. The preferred second and first cycle refrigerants are ethylene and propane, respectively.

When employing a three refrigerant cascaded closed cycle system, the refrigerant in the third cycle is compressed in a stagewise manner, preferably though optionally cooled via indirect heat transfer to an environmental heat sink (i.e., inter-stage and/or post-cooling following compression) and then cooled by indirect heat exchange with either all or selected cooling stages in the first and second cooling cycles which preferably employ propane and ethylene as respective refrigerants. Preferably, this stream is contacted in a sequential manner with each progressively colder stage of refrigeration in the first and second cooling cycles, respectively.

In an open-cycle cascaded refrigeration system such as that illustrated in FIG. 1, the first and second cycles are operated in a manner analogous to that set forth for the closed cycle. However, the open methane cycle system is readily distinguished from the conventional closed refrigeration cycles. As previously noted in the discussion of the fourth cycle or step, a significant portion of the liquefied natural gas stream originally present at elevated pressure is cooled to approximately—260 ° F. by expansion cooling in a stepwise manner to near-atmospheric pressure. In each step, significant quantities of methane-rich vapor at a given pressure are produced. Each vapor stream preferably undergoes significant heat transfer in the methane economizers and is preferably returned to the inlet port of a compressor stage at near-ambient temperatures. In the course of flowing through the methane economizers, the flashed vapors are contacted with warmer streams in a countercurrent manner and in a sequence designed to maximize the cooling of the warmer streams. The pressure selected for each stage of expansion cooling is such that for each stage, the volume of gas generated plus the compressed volume of vapor from the adjacent lower stage results in efficient overall operation of the multi-staged compressor. Interstage cooling and cooling of the final compressed gas is preferred and preferably accomplished via indirect heat exchange with one or more cooling agents directly coupled to an environment heat sink. The compressed methane-rich stream is then further cooled via indirect heat exchange with refrigerant in the first and second cycles, preferably the first cycle refrigerant in all stages, more preferably the first two stages and most preferably, only stage one. The cooled methane-rich stream is further cooled via indirect heat exchange with flash vapors in the main methane economizer and is then combined with the natural gas feed stream at a location in the liquefaction process where the natural gas feed stream and the cooled methane-rich stream are at similar conditions of temperature and pressure, preferably prior to entry into one of the stages of ethylene cooling, more preferably immediately prior to the first stage of ethylene cooling.

Optimization via Inter-stage and Inter-cycle Heat Transfer

In the more preferred embodiments, steps are taken to further optimize process efficiency by returning the refrigerant gas streams to the inlet port of their respective compressors at or near ambient temperature. Not only does this step improve overall efficiencies, but difficulties associated with the exposure of compressor components to cryogenic conditions are greatly reduced. This is accomplished via the use of economizers wherein streams comprised in major portion of liquid and prior to flashing are first cooled by indirect heat exchange with one or more vapor streams generated in a downstream expansion step (i.e., stage) or steps in the same or a downstream cycle. In a closed system, economizers are preferably employed to obtain additional cooling from the flashed vapors in the second and third cycles. When an open methane cycle system is employed, flashed vapors from the fourth stage are preferably returned to one or more economizers where (1) these vapors cool via indirect heat exchange the liquefied product streams prior to each pressure reduction stage and (2) these vapors cool via indirect heat exchange the compressed vapors from the open methane cycle prior to combination of this stream or streams with the main natural gas feed stream. These cooling steps comprise the previously discussed third stage of cooling and will be discussed in greater detail in the discussion of FIG. 1. In the one embodiment wherein ethylene and methane are employed in the second and third cycles, the contacting can be performed via a series of ethylene and methane economizers. In the preferred embodiment which is illustrated in FIG. 1 and which will be discuss in greater detail later, there is a main ethylene economizer, a main methane economizer and one or more additional methane economizers. These additional economizers are referred to herein as the second methane economizer, the third methane economizer and so forth and each additional methane economizer corresponds to a separate downstream flash step.

Load Balancing Between Refrigeration Compressor Gas Turbine Drivers

The improved process for transferring loads between gas turbine drivers associated with different refrigerant cycles in a cascaded refrigeration process nominally comprises contacting a higher boiling point refrigerant liquid in a given cycle via an indirect heat transfer means with a lower boiling point refrigerant vapor in another cycle prior to flashing said higher boiling point refrigerant liquid in the next subsequent stage and prior to returning vapor to the compressor for the lower boiling point refrigerant. Preferably, the cycles are adjacent to one another and are preferably closed cycles. When using a three cycle cascaded process, the more preferred cycles are those involving load balancing between propane and ethylene closed cycles and ethylene and methane closed cycles. Balancing between the propane and ethylene cycle is particularly preferred because of its simplicity, ease of implementation, low initial capital cost, and overall effectiveness. These factors become still more significant when an open methane cycle is employed.

The apparatus for transferring compressor loading among gas turbine drivers associated with different refrigeration cycles in a cascaded refrigeration cycle is nominally comprised of a conduit for flowing a higher boiling point refrigerant liquid to an indirect heat transfer means, a conduit for flowing the lower boiling point refrigerant vapor to said indirect heat transfer means, an indirect heat transfer means, a conduit for following the heated lower boiling point refrigerant vapor from the indirect heat transfer means to a compressor, a conduit for flowing the cooled higher boiling point refrigerant liquid to a pressure reduction means and a pressure reduction means. In a preferred embodiment, the degree of cooling can be adjusted and routinely controlled by modifying the conduit delivering the high boiling point refrigerant stream to the indirect heat transfer means. This modification comprises the addition of a splitting means for splitting the flow of higher boiling point refrigerant delivered by the higher boiling refrigerant conduit, a first conduit connected to the splitting means enabling a portion of the higher boiling point refrigerant to bypass the indirect heat exchange means, a second conduit connected to the splitting means for flowing the higher boiling point refrigerant to the heat exchange means, a third conduit connected to the heat exchange means for returning the cooled refrigerant stream. Situated in said first, second and/or third conduits are means for controlling the relative flow rates of refrigerant through the respective conduits. Such means for controlling are readily available to those skilled in the art and may comprise a flow control valve situated in one conduit and, if required for proper flow control, a flow restriction means such as an orifice or valve in the remaining conduit so as provide sufficient pressure drop in this conduit for efficient operation of the flow control system. In a preferred embodiment, the flow control valve is situated in the first conduit. If so required in this embodiment, the pressure restriction means is situated in the second or third conduit or in the indirect heat transfer means. The first and third conduits referred to above may be connected to individual pressure reduction means or may be first combined via a combining means which is also connected to a conduit which is in turn connected to a pressure reduction means.

Associated with the preceding process and apparatus is a unique methodology and associated equipment for balancing or distributing the loads among the gas turbine drivers which provide compression power to adjacent refrigeration cycles in a cascaded refrigeration process. The process comprises the steps of (1) determining the loadings of the drivers for the higher boiling point refrigeration cycle and the lower boiling point refrigeration cycle, (2) comparing the respective loadings of each thereby determining the direction of driver loading transfer for improved operation, (3) flowing at least a portion of the lower boiling point refrigerant vapor stream to an indirect heat transfer means thereby producing a processed vapor stream, (4) flowing said processed vapor stream to the low boiling point refrigerant compressor, (5) splitting the high boiling point refrigerant liquid stream into a first liquid stream and a second liquid stream, (6) flowing said second stream to an indirect heat transfer means thereby producing a cooled second liquid stream, (7) controlling the relative flow of said first liquid stream and cooled second liquid stream responsive to step (2) via a means for flow control wherein the flowrate of said second liquid stream is increased as load transfer to the lower boiling point refrigerant driver is increased, and (8) either recombining said cooled second liquid stream with said first liquid stream to produce a combined liquid stream and flowing said combined stream to a pressure reduction means or flowing said first stream and cooled second stream to separate pressure reduction means. Gas turbine driver loading may be determined using any means readily available to those skilled in the art. For a given turbine, operational data such as fuel usage, exhaust temperature, turbine speed, ambient conditions, degree of air precooling, and elapsed time since maintenance may be employed. Additionally, information specific to the performance characteristics of the gas turbine driver will be required. When this analysis has been completed, preferably for all gas turbine drivers in the refrigeration cycles of concern, an informed decision can be made regarding whether operation can be improved by transferring load from a driver or drivers in one cycle to a driver or drivers in an adjacent cycle. This transfer will be accomplished by operator adjustment to the control means in step (7) above. In a preferred embodiment, the cooled second liquid stream and first liquid stream will be combined prior to pressure reduction and the temperature of the combined stream will be measured. In this embodiment, one means of adjusting the control means is by measurement of the temperature of the combined stream. If the operator desires to increase load transfer to the lower boiling point refrigeration cycle, he would lower the set point on a temperature controller connected to the control means thereby increasing flow to the indirect heat transfer means. In a similar manner, the operator could decrease load transfer to the low boiling point refrigeration cycle by increasing the set point temperature.

Preferred Open-Cycle Embodiment of Cascaded Liquefaction Process

Figure 2:
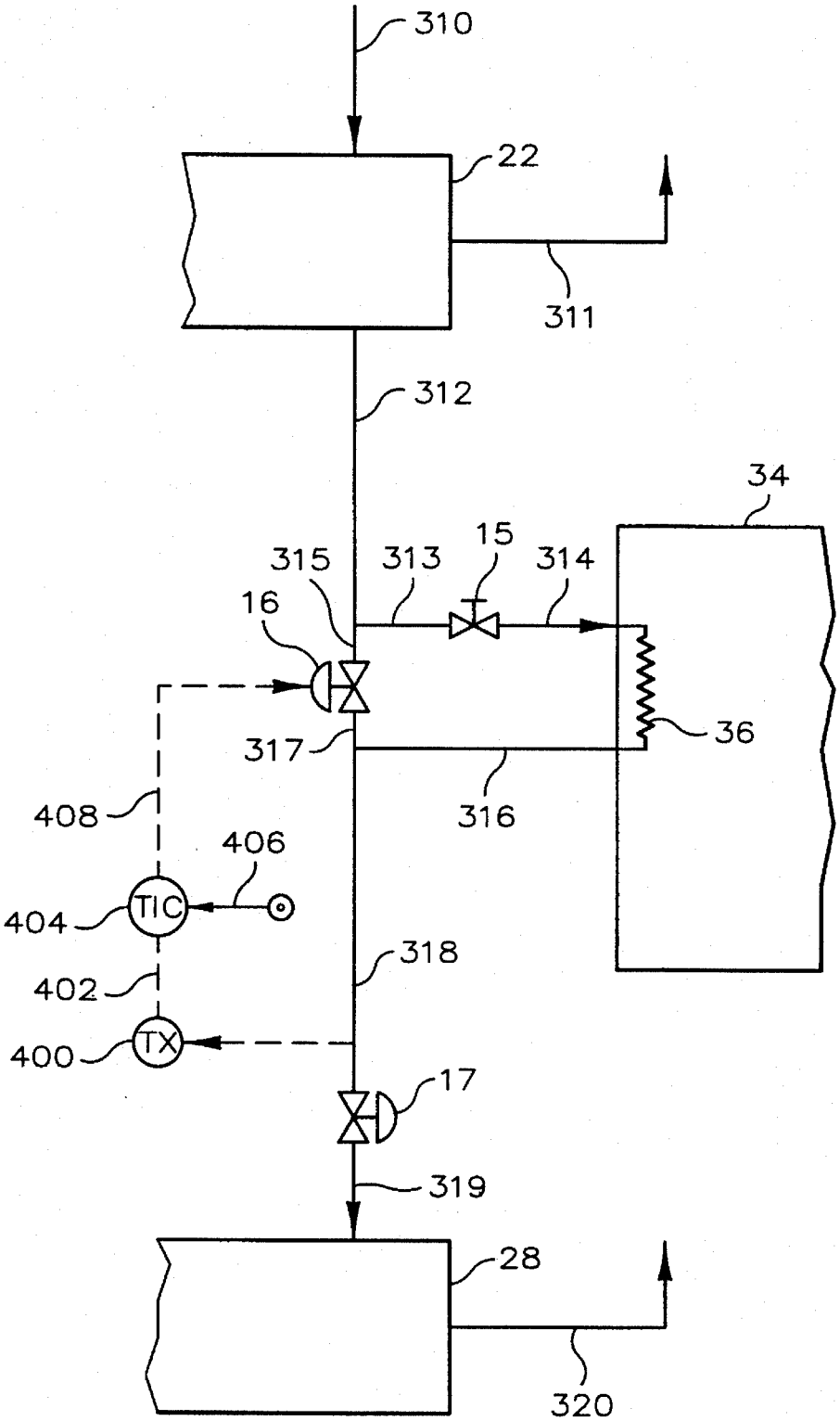
FIG. 2 is a simplified flow diagram which illustrates in greater detail the load distribution methodology and apparatus illustrated in FIG. 1.

The flow schematic and apparatus set forth in FIG. 1 is a preferred embodiment of the open-cycle cascaded liquefaction process and is set forth for illustrative purposes. Purposely missing from the preferred embodiment is a nitrogen removal system, because such system is dependant on the nitrogen content of the feed gas. However as noted in the previous discussion of nitrogen removal technologies, methodologies applicable to this preferred embodiment are readily available to those skilled in the art. Those skilled in the art will also recognized that FIGS. 1 and 2 are schematics only and therefore, many items of equipment that would be needed in a commercial plant for successful operation have been omitted for the sake of clarity. Such items might include, for example, compressor controls, flow and level measurements and corresponding controllers, additional temperature and pressure controls, pumps, motors, filters, additional heat exchangers, and valves, etc. These items would be provided in accordance with standard engineering practice.

To facilitate an understanding of the Figure, items numbered 1 thru 99 are process vessels and equipment directly associated with the liquefaction process. Items numbered 100 thru 199 correspond to flow lines or conduits which contain methane in major portion. Items numbered 200 thru 299 correspond to flow lines or conduits which contain the refrigerant ethylene. Items numbered 300–399 correspond to flow lines or conduits which contain the refrigerant propane. Items numbered 400–499 correspond to process control instrumentation associated with load-balancing.

A feed gas, as previously described, is introduced to the system through conduit 100. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative pressure and temperature of the liquefied propane refrigerant prior to flashing is about 100 ° F. and about 190 psia. Although not illustrated in FIG. 1, it is preferable that a separation vessel be located downstream of cooler 20 and upstream of expansion valve 12 for the removal of residual light components from the liquefied propane. Such vessels may be comprised of a single-stage gas liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is pass through conduit 302 to a pressure reduction means such as a expansion valve 12 wherein the pressure of the liquefied propane is reduced thereby evaporating or flashing a portion thereof. The resulting two-phase product then flows through conduit 304 into high-stage propane chiller 2 wherein indirect heat exchange with gaseous methane refrigerant introduced via conduit 152, natural gas feed introduced via conduit 100 and gaseous ethylene refrigerant introduced via conduit 202 are respectively cooled via indirect heat exchange means 4, 6 and 8 thereby producing cooled gas streams respectively produced via conduits 154, 102 and 204.

The flashed propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to chiller 22 through conduit 310 thereby providing a coolant for chiller 22.

The cooled feed gas stream from chiller 2 flows via conduit 102 to a knock-out vessel 10 wherein gas and liquid phases are separated. The liquid phase which is rich in C3+ components is removed via conduit 103. The gaseous phase is removed via conduit 104 and conveyed to propane chiller 22. Ethylene refrigerant is introduced to chiller 22 via conduit 204. In the chiller, the methane-rich and ethylene refrigerant streams are respectively cooled via indirect heat transfer means 24 and 26 thereby producing cooled methane-rich and ethylene refrigerant streams via conduits 110 and 206. The thus evaporated portion of the propane refrigerant is separated and passed through conduit 311 to the intermediate-stage inlet of compressor 18.

FIG. 2 illustrates in greater detail the novel feature of transferring refrigeration capacity and therefore actually, making horsepower from the ethylene refrigeration cycle available to the propane refrigeration cycle. Liquid propane refrigerant is removed from the intermediate stage propane chiller 22 via conduit 312 which is subsequently split and transferred via conduits 313 and 315. Liquid propane refrigerant in conduit 313 flows to a valve 15, preferably a butterfly valve, which acts as a flow restriction means thereby insuring sufficient pressure drop associated with flow through 314, 36 and 316 for operation of the flow control system. The liquid propane flows to the ethylene economizer 34 via conduit 314 wherein the fluid is subcooled by indirect heat transfer from streams illustrated in FIG. 1, via transfer means 36 and then exits the ethylene economizer 34 via conduit 316. The flowrate of propane refrigerant through the ethylene economizer is adjusted by manipulating the flowrate of fluid into conduit 315 responsive to the temperature of the combined stream in conduit 318 as more fully explained hereinafter. As illustrated, the rate of fluid flowing in conduit 315 is manipulated via a control valve 16. The fluid exits control valve 16 in conduit 317 which is subsequently joined to conduit 316 which provides a conduit for the subcooled propane refrigerant. The combined stream then flows in conduit 318 to expansion means 17 wherein a two-phase mixture at reduced pressure and temperature is produced and this mixture then flows to the low pressure chiller 28 via conduit 319 where it functions as a coolant via indirect heat transfer means 30 and 32.

As illustrated in FIG. 1, the methane-rich stream flows from the intermediate-stage propane chiller 22 to the low-stage propane chiller/condenser 28 via conduit 110. In this chiller, the stream is cooled via indirect heat exchange means 30. In a like manner, the ethylene refrigerant stream flows from the intermediatestage propane chiller 22 to the low-stage propane chiller/condenser 28 via conduit 206. In the latter, the ethylene-refrigerant is condensed via an indirect heat exchange means 32 in nearly its entirety. The vaporized propane is removed from the low-stage propane chiller/condenser 28 and returned to the low-stage inlet at the compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1, the methane-rich stream exiting the low-stage propane chiller is introduced to the high-stage ethylene chiller 42 via conduit 112. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant via conduit 210 then flows to the ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to the high-stage ethylene chiller 42 via conduit 212. Vapor is removed from this chiller via conduit 214 and routed to the ethane economizer 34 wherein the vapor functions as a coolant via indirect heat exchange means 46. The ethylene vapor is then removed from the ethylene economizer via conduit 216 and feed to the high-stage inlet on the ethylene compressor 48. The ethylene refrigerant which is not vaporized in the high-stage stage ethylene chiller 42 is removed via conduit 218 and returned to the ethylene economizer 34 for further cooling via indirect heat exchange means 50, removed from the ethylene economizer via conduit 220 and flashed in a pressure reduction means illustrated as expansion valve 52 whereupon the resulting two-phase product is introduced into the low-stage ethylene chiller 54 via conduit 222. The methane-rich stream is removed from the high-stage ethylene chiller 42 via conduit 116 and directly fed to the low-stage ethylene chiller 54 wherein it undergoes additional cooling and partial condensation via indirect heat exchange means 56. The resulting two-phase stream then flows via conduit 118 to a two phase separator 60 from which is produced a methane-rich vapor stream via conduit 120 and via conduit 117, a liquid stream rich in $C_2$+ components which is subsequently flashed or fractionated in vessel 67 thereby producing via conduit 123 a heavies stream and a second methane-rich stream which is transferred via conduit 121 and after combination with a second stream via conduit 128 is fed to the high pressure inlet port on the methane compressor 83. The stream in conduit 120 and the stream in conduit 158 which contains a cooled compressed methane recycle stream are combined and fed to the low-stage ethylene condenser 68 wherein this stream exchanger heats via indirect heat exchange means 70 with the liquid effluent from the low-stage ethylene chiller 54 which is routed to the low-stage ethylene condenser 68 via conduit 226. In condenser 68, combined streams respectively provided via conduits 120 and 158 are condensed and produced from condenser 68 via conduit 122. The vapor from the low-stage ethylene chiller 54 via conduit 224 and low-stage ethylene condenser 68 via conduit 228 are combined and routed via conduit 230 to the ethylene economizer 34 wherein the vapors function as a coolant via indirect heat exchange means 58. The stream is then routed via conduit 232 from the ethylene economizer 34 to the low-stage side of the ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from the cooler flows via conduit 202 and is introduced, as previously discussed, to the high-stage propane chiller 2

The liquefied stream in conduit 122 is generally at a temperature of about −125 ° F. and about 600 psi. This stream passes via conduit 122 through the main methane economizer 74 wherein the stream is further cooled by indirect heat exchange means 76 as hereinafter explained. From the main methane economizer 74 the liquefied gas passes through conduit 124 and its pressure is reduced by a pressure reductions means which is illustrated as expansion valve 78, which of course evaporates or flashes a portion of the gas stream. The flashed stream is then passed to methane high-stage flash drum 80 where it is separated into a gas phase discharged through conduit 126 and a liquid phase discharged through conduit 130. The gas-phase is then transferred to the main methane economizer via conduit 126 wherein the vapor functions as a coolant via indirect heat transfer means 82. The vapor exits the main methane economizer via conduit 128 where it is combined with the gas stream delivered by conduit 121. These streams are then fed to the high pressure side of compressor 83. The liquid phase in conduit 130 is passed through a second methane economizer 87 wherein the liquid is further cooled by downstream flash vapor via indirect heat exchange means 88. The cooled liquid exits the second methane economizer 87 via conduit 132 and is expanded or flashed via pressure reduction means illustrated as expansion valve 91 to further reduce the pressure and at the same time, evaporate a second portion thereof. This flash stream is then passed to intermediate-stage methane flash drum 92 where the stream is separated into a gas phase passing through conduit 136 and a liquid phase passing through conduit 134. The gas phase flows through conduit 136 to the second methane economizer 87 wherein the vapor cools the liquid introduced to 87 via conduit 130 via indirect heat exchanger means 89. Conduit 138 serves as a flow conduit between indirect heat exchange means 89 in the second methane economizer 87 and the indirect heat transfer means 95 in the main methane economizer 74. This vapor leaves the main methane economizer 74 via conduit 140 which is connected to the intermediate stage inlet on the methane compressor 83. The liquid phase exiting the intermediate stage flash drum 92 via conduit 134 is further reduced in pressure, preferably to about 25 psia, by passage through a pressure reduction means illustrated as a expansion valve 93. Again, a third portion of the liquefied gas is evaporated or flashed. The fluids from the expansion valve 93 are passed to final or low stage flash drum 94. In flash drum 94, a vapor phase is separated and passed through conduit 144 to the second methane economizer 87 wherein the vapor functions as a coolant via indirect heat exchange means 90, exits the second methane economizer via conduit 146 which is connected to the first methane economizer 74 wherein the vapor functions as a coolant via indirect heat exchange means 96 and ultimately leaves the first methane economizer via conduit 148 which is connected to the low pressure port on compressor 83. The liquefied natural gas product from flash drum 94 which is at approximately atmospheric pressure is passed through conduit 142 to the storage unit. The low pressure, low temperature LNG boil-off vapor stream from the storage unit is preferably recovered by combining this stream with the low pressure flash vapors present in either conduits 144, 146, or 148; the selected conduit being based on a desire to match vapor stream temperatures as closely as possible.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas in conduit 128 prior to the third-stage of compression. The compressed gas is discharged from high stage methane compressor through conduit 150, is cooled in cooler 86 and is routed to the high pressure propane chiller via conduit 152 as previously discussed.

FIG. 1 depicts the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a propane chiller. In a like manner, certain process streams undergoing expansion are ideal candidates for employment of a hydraulic expander as part of the pressure reduction means thereby enabling the extraction of work and also lower two-phase temperatures.

With regard to the compressor/driver units employed in the process, FIG. 1 depicts individual compressor/driver units (i.e., a single compression train) for the propane, ethylene and open-cycle methane compression stages. However in a preferred embodiment for any cascaded process, process reliability can be improved significantly by employing a multiple compression train comprising two or more compressor/driver combinations in parallel in lieu of the depicted single compressor/driver units. In the event that a compressor/driver unit becomes unavailable, the process can still be operated at a reduced capacity. In addition by shifting loads among the compressor/driver units in the manner herein disclosed, the LNG production rate can be further increased when a compressor/driver unit goes down or must operate at reduced capacity.

As noted, the degree of net cooling of the liquid propane refrigerant between the intermediate stage chiller 22 and the low stage pressure reduction means 17 is controlled by the amount of refrigerant allowed to flow through control valve 16 so as to by pass the indirect heat transfer means 34.

The position of control valve 16 (i.e., degree to which fluid can flow through the valve) is manipulated responsive to the actual temperature of the fluid flowing in conduit 318. A temperature transducer 400 in combination with a temperature sensing device such as a thermocouple operably located in conduit 318 establishes an output signal 402 that typifies the actual temperature of the fluid in conduit 318. Signal 402 provides a process variable input to temperature controller 404. Temperature controller 404 is also provided with a setpoint signal 406 that may be entered manually by an operator, or alternately under computer control via a control algorithm. In either case the setpoint signal is based on the relative loading of the turbines driving the propane and ethylene compressors.

In response to the signals 402 and 406, the temperature controller 404 provides an output signal 408 responsive to the difference between signals 402 and 406. Signal 408 is scaled so as to be representative of the position of control valve 16 required to maintain the temperature of fluid in conduit 318 represented by signal 402 substantially equal to the desired temperature represented by setpoint signal 406. Signal 408 is provided from temperature controller 404 to control valve 16, and control valve 16 is manipulated in response to signal 408.

The temperature controller 404 may use the various well-known modes of control such as proportional, proportional-integral, or proportional-integral-derivative (PID). In this preferred embodiment a proportional-integral controller is utilized, but any controller capable of accepting two input signals and producing a scaled output signal, representative of a comparison of the two input signals, is within the scope of the invention. The operation of PID controllers is well known in the art. Essentially, the output signal of a controller may be scaled to represent any desired factor or variable. One example is where a desired temperature and an actual temperature are compared by a controller. The controller output could be a signal representative of a change in the flow rate of some fluid necessary to make the desired and actual temperatures equal. On the other hand, the same output signal could be scaled to represent a percentage, or could be scaled to represent a pressure change required to make the desired and actual temperatures equal.

While specific cryogenic methods, materials, items of equipment and control instruments are referred to herein, it is to be understood that such specific recitals are not to be considered limiting but are included by way of illustration and to set forth the best mode in accordance with the present invention.

EXAMPLE I

This Example shows via a computer simulation of the cascade refrigeration process that the transfer of compressor driver loading from the propane to the ethylene cycle in a cascaded LNG process can be performed in a cost effective manner when using the inventive process and apparatus herein claimed.

Simulation results were obtained using Hyprotech's Process Simulation HYSIM, version 386/C2.10, Prop. Pkg PR/LK. The simulations were based on the open methane cycle, cascaded LNG process configuration and assumed the following conditions:

| | |
|---|---|
| Feed Gas Volume | 212.9 MMSCF/Day |
| LNG Produced in Storage | 190.3 MMSCF/Day |
| Feed Gas Pressure | 660 psia |
| Feed Gas Temperature | 100 F. |
| Total Refrigeration HP | 76,252 HP |

Simulated refrigerants employed in the first and second cycles were propane and ethylene, respectively. The propane cycle employed three stages of cooling whereas the ethylene employed two stages of cooling. The open methane cycle was configured to employed three distinct flash steps and therefore, required three stages of compression.

The simulation results presented herein focus exclusively on a comparative analysis of horsepower requirements for the propane and ethylene cycles with and without load balancing. Because of the comparative nature of the results, a detailed explanation of the liquefaction train configuration external to these two cycles will not be presented. The goal of these simulation studies was to maximize process efficiency. The key issue was whether the base case could be modified in a cost effective manner thereby resulting in a more cost effective liquefaction process.

In the current simulations, refrigerants were fed to the chillers in a sequential manner in the manner illustrated in FIG. 1, (ex., liquid refrigerant from the higher pressure or first-stage chiller was flashed and then fed as a two-phase mixture to the lower pressure or second-stage chiller). The key factor distinguishing the two simulations is employment in the latter case of the load balancing methodology illustrated in detail in FIG. 2 wherein liquid propane refrigerant from the intermediate stage propane chiller is first routed to the ethylene economizer for subcooling prior to flashing.

In the simulation studies, the horsepower requirement for the methane compressor was maintained constant. The horsepower requirements for the propane and ethylene compressors for the base and load balancing simulations and the resulting shift in horsepower is presented in Table I.

TABLE I

| | Horsepower Requirements | | |
|---|---|---|---|
| | Propane Compressor Horsepower | Ethylene Compressor Horsepower | Total Horsepower |
| Base Case | 28,435 | 24,249 | 52,684 |
| Load Balancing | 26,836 | 25,315 | 52,151 |
| HP Shift | −1599 | 1066 | 532 |

The capital cost to implement the changes for load balancing is approximately $30,000. A key factor in the relatively small incremental cost figure is the configuration and characteristics of the streams undergoing heat exchange. The stream undergoing cooling is a relatively low volumetric flow liquid stream and the stream providing cooling capabilities is readily available as a flash vapor in the ethylene economizer.

Assuming the horsepower savings from load shifting presented in Table I of 532 HP, a turbine efficiency of 7,000 BTU/HP-hr, a turbine availability factor of 93%, and a natural gas cost of $1.00/MMBTU, the net savings on a yearly basis from load balancing is approximately $30,300. Therefore, the payback time for the recovery of the capital costs associated with the load balancing modifications is about one year. Based on an anticipated plant life of at least 20 years, at least 19 years of plant operation following initial payback would be anticipated.

That which is claimed:

1. In a cascaded refrigeration process, the improvement comprising a process for transferring compressor loads from a driver in a first refrigerant cycle containing a higher boiling point refrigerant to a driver in a second refrigerant cycle containing a lower boiling point refrigerant comprising:

(a) contacting a controlled amount of the higher boiling point refrigerant liquid in the first refrigeration cycle via an indirect heat transfer means with the lower boiling point refrigerant vapor in a second refrigeration cycle thereby producing a cooled refrigerant liquid and a heated refrigerant vapor;

(b) flashing said subcooled refrigerant liquid thereby making available additional refrigerative cooling to the first refrigerant cycle; and (c) returning said heated refrigerant vapor to the compressor in the second refrigeration cycle.

2. A process according to claim 1 wherein said higher boiling point liquid is comprised in major portion of propane or propylene or a mixture thereof and said lower boiling point liquid is comprised in major portion of ethane or ethylene or a mixture thereof.

3. A process according to claim 2 wherein said higher boiling point liquid is comprised in major portion of propane and said lower boiling point liquid is comprised in major portion of ethylene.

4. A process according to claim 3 wherein said higher boiling point liquid consists essentially of propane and said lower boiling point liquid consists essentially of ethylene.

5. A process according to claim 1 wherein said higher boiling point liquid is comprised in major portion of ethane and ethylene or a mixture thereof and said lower boiling point liquid is comprised in major portion of methane thereof.

6. A process according to claim 5 wherein said higher boiling point liquid is comprised in major portion of ethylene.

7. A process according to claim 6 wherein said higher boiling point liquid consists essentially of ethylene and said lower boiling point liquid consists essentially of methane and nitrogen.

8. A process according to claim 7 wherein said higher boiling point liquid consists essentially of ethylene and said lower boiling point liquid consists essentially of methane.

9. An apparatus for transferring compressor loading from a driver in a first refrigeration cycle containing a higher boiling point refrigerant to a driver in a second refrigeration cycle containing a lower boiling point refrigerant, said apparatus comprising (a) a first conduit for flowing the higher boiling point refrigerant liquid to an indirect heat transfer means;

(b) a second conduit for flowing the lower boiling point refrigerant vapor to said indirect heat transfer means;

(c) a third conduit for flowing the higher boiling point refrigerant liquid from said indirect heat exchange means to a pressure reduction means in said first refrigeration cycle;

(d) a fourth conduit connecting said first conduit to said third conduit so as to provide a bypass flow path around said indirect transfer means;

(e) a fifth conduit for flowing said lower boiling point refrigerant vapor from said indirect heat transfer means to a compressor in said second refrigeration cycle;

(f) said indirect heat transfer means;

(g) said compressor;

(h) said pressure reduction means; and (i) means for manipulating the relative flow rates of said higher boiling point refrigerant liquid through said fourth conduit and said indirect heat transfer means.

10. An apparatus according to claim 9 further comprising (j) a flow restriction means situated in said first conduit, said indirect heat transfer means or said third conduit between the junction of said first conduit and said fourth conduit and the junction of said third conduit and fourth conduit; and (k) a control valve operatively connected in said fourth conduit.

11. An apparatus according to claim 10 wherein said means for manipulating the relative flow rates of said higher boiling point refrigerant liquid through said fourth conduit and said indirect heat exchange transfer means comprises:

(a) means for establishing a first signal representative of the actual temperature of fluid flowing in said third conduit at a location downstream of the junction with the fourth conduit;

(b) means for establishing a second signal representative of the desired temperature of fluid flowing in said third conduit at a location downstream of the junction with the fourth conduit;

(c) a temperature controller means for establishing a third signal responsive to the difference between said first signal and said second signal, wherein said third signal is scaled so as to be representative of the position of said control valve required to maintain the actual temperature of said fluid flowing in said third conduit substantially equal to the desired temperature represented by said second signal; and (d) means for manipulating said control valve responsive to said third signal to adjust the relative flow rate of fluid flowing in said fourth conduit and fluid flowing to said indirect heat transfer means.

12. An apparatus according to claim 9 additionally comprising a conduit connecting said pressure reduction means to a chiller; and a chiller.

13. A control methodology for transferring loads between drivers in adjacent refrigeration cycles in a cascaded refrigeration process wherein a higher boiling point refrigerant liquid in one cycle is cooled prior to flashing by contacting via an indirect heat transfer means a lower boiling point refrigerant vapor in a adjacent cycle prior to compression of said vapor comprising (a) determining the loadings of the drivers for the higher boiling point and lower boiling point refrigeration cycles;

(b) comparing the respective loadings of each driver thereby determining the direction of driver loading transfer for more efficient driver operation;

(c) flowing at least a portion of the lower boiling point refrigerant vapor stream to an indirect heat transfer means thereby producing a heated vapor stream;

(d) flowing said processed vapor stream to the low boiling point refrigerant compressor;

(e) splitting the high boiling point refrigerant liquid stream into a first liquid stream and a second liquid stream;

(f) flowing said liquid second stream to said indirect heat transfer means thereby producing a cooled second stream; and (g) controlling the relative flow of said first stream and said second stream responsive to step (b) above via a control valve wherein the flowrate of said second liquid stream is increased as load transfer to the lower boiling point refrigerant driver is increased.

14. A process according to claim 13 additionally comprising the steps of (h) recombining said cooled second stream with said first stream to produce a combined stream; and (i) flowing said combined stream to a pressure reduction means.

15. A process according to claim 14 additionally comprising the steps (h) flowing said first stream to pressure reduction means; and (i) flowing said cooled second stream to a pressure reduction means.

16. A process according to claim 13 wherein said higher boiling point liquid is comprised in major portion of propane or propylene or a mixture thereof and said lower boiling point liquid is comprised in major portion of ethane or ethylene or a mixture thereof.

17. A process according to claim 16 wherein said higher boiling point liquid is comprised in major portion of propane and said lower boiling point liquid is comprised in major portion of ethylene.

18. A process according to claim 17 wherein said higher boiling point liquid consists essentially of propane and said lower boiling point liquid consists essentially of ethylene.

19. A process according to claim 18 wherein said higher boiling point liquid is comprised in major portion of ethane and ethylene or a mixture thereof and said lower boiling point liquid is comprised in major portion of methane thereof.

20. A process according to claim 19 wherein said higher boiling point liquid is comprised in major portion of ethylene.

21. A process according to claim 20 wherein said higher boiling point liquid consists essentially of ethylene and said lower boiling point liquid consists essentially of methane and nitrogen.

22. A process according to claim 21 wherein said higher boiling point liquid consists essentially of ethylene and said lower boiling point liquid consists essentially of methane.

* * * * *